US011003131B2

(12) United States Patent
Sano et al.

(10) Patent No.: US 11,003,131 B2
(45) Date of Patent: May 11, 2021

(54) IMAGE FORMING APPARATUS

(71) Applicant: BROTHER KOGYO KABUSHIKI KAISHA, Nagoya (JP)

(72) Inventors: Toshiyuki Sano, Aichi (JP); Tadao Kyotani, Nagoya (JP); Keigo Goto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/515,423

(22) Filed: Jul. 18, 2019

(65) Prior Publication Data

US 2020/0033790 A1 Jan. 30, 2020

(30) Foreign Application Priority Data

Jul. 25, 2018 (JP) ..... JP2018-139231

(51) Int. Cl.
*G03G 21/18* (2006.01)
*G03G 15/08* (2006.01)
*G03G 15/01* (2006.01)

(52) U.S. Cl.
CPC ..... *G03G 21/1839* (2013.01); *G03G 15/0152* (2013.01); *G03G 15/0194* (2013.01); *G03G 15/087* (2013.01); *G03G 15/0848* (2013.01)

(58) Field of Classification Search
None
See application file for complete search history.

(56) References Cited

U.S. PATENT DOCUMENTS

| | | | |
|---|---|---|---|
| 2002/0063890 | A1* | 5/2002 | Hayashi et al. |
| 2004/0095454 | A1 | 5/2004 | Maeda |
| 2004/0105689 | A1* | 6/2004 | Shimura et al. |
| 2009/0175637 | A1* | 7/2009 | Imamura et al. |
| 2011/0222882 | A1* | 9/2011 | Sugiyama et al. |
| 2015/0309441 | A1* | 10/2015 | Homma et al. |

FOREIGN PATENT DOCUMENTS

| | | | |
|---|---|---|---|
| JP | 2004-126528 | A | 4/2004 |
| JP | 2006-79010 | A | 3/2006 |
| JP | 2013072902 | A * | 4/2013 |

* cited by examiner

*Primary Examiner* — Sevan A Aydin
(74) *Attorney, Agent, or Firm* — Merchant & Gould P.C.

(57) ABSTRACT

An image forming apparatus includes a frame, a drum cartridge mountable to the frame, and including a photosensitive drum and a drum memory in which drum identification information identifying the drum cartridge is stored, and a control unit including a main body memory in which the drum identification information is to be stored. The control unit reads out the drum identification information from the drum memory, determines whether the drum identification information read out from the drum memory coincides with the drum identification information stored in the main body memory, and enables to execute resister pitch measuring processing of measuring variations in printing pitch due to the photosensitive drum. In a case where it is determined that the drum identification information read out from drum memory coincides with the drum identification information stored in the main body memory, the control unit does not execute the resister pitch measuring processing.

13 Claims, 13 Drawing Sheets

IMAGE FORMING APPARATUS

CROSS-REFERENCE TO RELATED APPLICATION

This application claims priority from Japanese Patent Application No. 2018-139231 filed on Jul. 25, 2018, the entire subject-matter of which is incorporated herein by reference.

TECHNICAL FIELD

The present disclosure relates to an image forming apparatus.

BACKGROUND

In the related art, an electrophotographic image forming apparatus such as an LED printer is known. This type of the image forming apparatus includes a frame, and a cartridge which is detachably mounted to the frame. The image forming apparatus having the cartridge is disclosed in a prior art. In the prior art, the cartridge has a photosensitive drum. When executing printing processing in the image forming apparatus, the photosensitive drum is rotated, and a toner image is transferred from the photosensitive drum to a print sheet.

SUMMARY

An outer peripheral surface of the photosensitive drum does not necessarily have an ideal cylindrical shape. When there is variations in the shape of the outer peripheral surface of the photosensitive drum, variations occurs in a printing pitch, too. For this reason, when there is a possibility that the cartridge has been exchanged, such as when a power supply is switched from an off state to an on state or when a cover is switched from an opened state to a closed state, the image forming apparatus executes resister pitch measuring processing. The resister pitch measuring processing is processing of measuring variations in printing pitch due to the shape of the outer peripheral surface of the photosensitive drum.

However, even in the case that the power supply is switched from the off state to the on state or the cover is switched from the opened state to the closed state, there may be a case in which the cartridge has not been exchanged. Although the resister pitch measuring processing is not necessary in this case, the image forming apparatus executes the resister pitch measuring processing. Thereby, operating time of the image forming apparatus is prolonged.

An object of the present disclosure is to provide an image forming apparatus capable of shortening operating time of the image forming apparatus by determining whether it is necessary to execute resister pitch measuring processing.

An image forming apparatus includes:

a frame;

a drum cartridge mountable to the frame, and including a photosensitive drum and a drum memory in which drum identification information identifying the drum cartridge is stored; and a control unit including a main body memory in which the drum identification information is to be stored, in which the control unit is configured to execute:

first readout processing of reading out the drum identification information from the drum memory of the drum cartridge mounted to the frame;

drum determination processing of determining whether the drum identification information read out in the first readout processing coincides with the drum identification information stored in the main body memory; and resister pitch measuring processing of measuring variations in printing pitch due to the photosensitive drum, and in which in a case where it is determined in the drum determination processing that the drum identification information read out in the first readout processing coincides with the drum identification information stored in the main body memory, the control unit does not execute the resister pitch measuring processing.

DETAILED DESCRIPTION

Hereinbelow, an exemplary embodiment of the present disclosure will be described with reference to the drawings.

<1. Configuration of Image Forming Apparatus>

Figure 1:
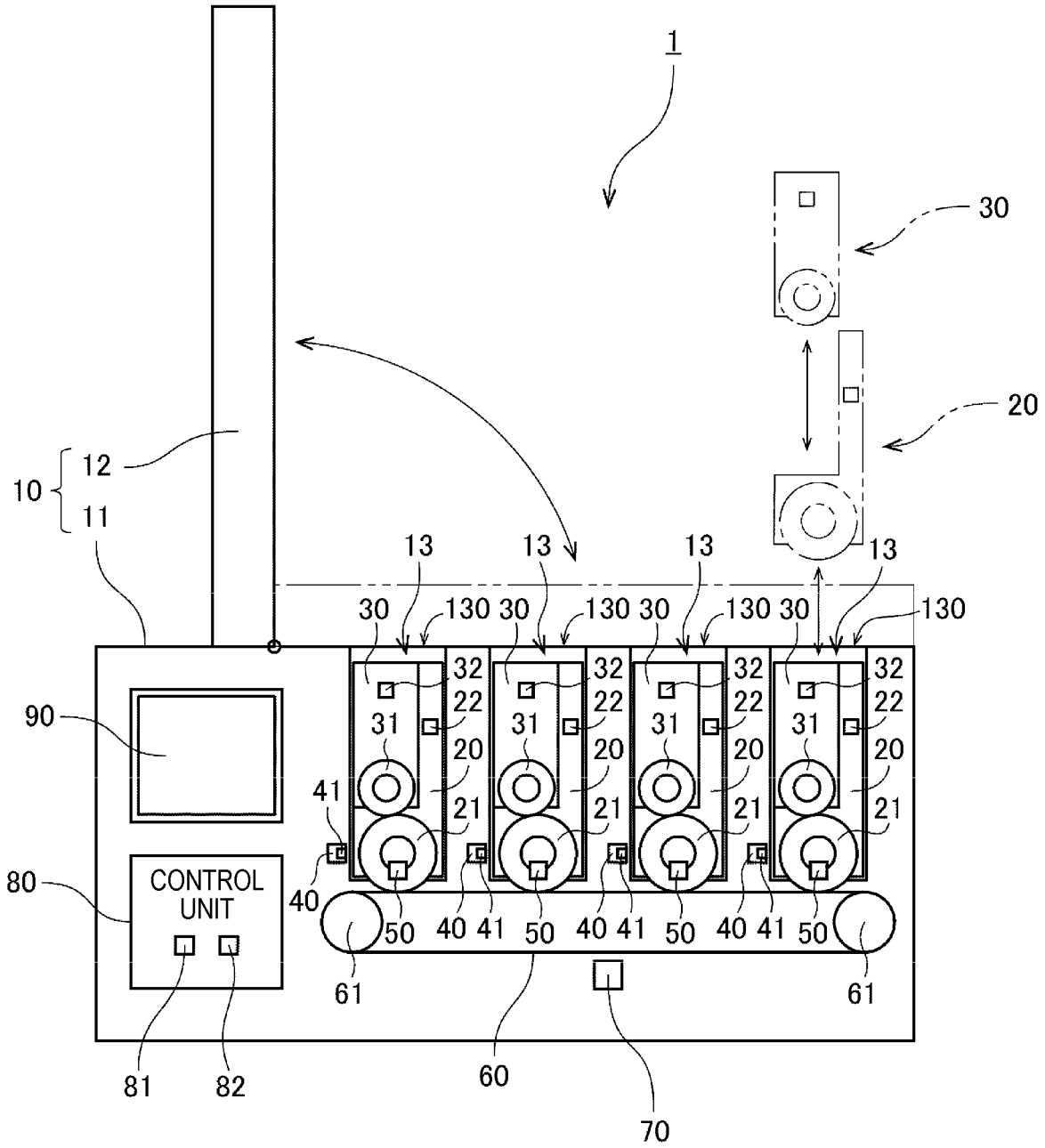
FIG. 1 is an outline view of an image forming apparatus.

FIG. 1 is an outline view of an image forming apparatus. The image forming apparatus 1 is an electrophotographic printer. As the image forming apparatus 1, an LED printer may be exemplified. As shown in FIG. 1, the image forming apparatus 1 includes a casing 10, four drum cartridges 20, four developing cartridges 30, four light source units 40, four original point sensors 50, a transfer belt 60, an image sensor 70, a control unit 80, and a display 90.

The casing 10 has a frame 11 and a cover 12. The four drum cartridges 20, the four developing cartridges 30, the four light source units 40, the four original point sensors 50, the transfer belt 60, the image sensor 70, and the control unit 80 are accommodated in the casing 10. The frame 11 has four cartridge holders 13. Each of the cartridge holders 13 has an opening 130. The cover 12 can rotate between a closed position shown with a dashed-two dotted line in FIG. 1 and an opened position shown with a solid line. When the cover 12 is arranged in the closed position, the four openings 130 are covered by the cover 12. When the cover 12 is arranged in the opened position, the four openings 130 are opened.

The drum cartridge 20 can be detachably mounted to the cartridge holder 13. The drum cartridge 20 includes a photosensitive drum 21. The photosensitive drum 21 is a cylindrical member. The photosensitive drum 21 is rotatable about a central axis thereof. An outer peripheral surface of the photosensitive drum 21 is covered with a photosensitive material. Also, the drum cartridge 20 has a drum memory 22. The drum memory 22 is a storage medium to and from which information can be written and read out. As the drum memory 22, for example, a flash ROM or an EEPROM is used.

In the drum memory 22, information about the drum cartridge 20 is stored. Specifically, in the drum memory 22, at least drum identification information (for example, serial number) capable of identifying each drum cartridge 20 is stored. Also, in the drum memory 22, worked time of the drum cartridge 20 and a specification of the original point sensor 50 are stored. The work time is a total period of time for which the drum cartridge 20 actually operates. Also, in the drum memory 22, a type of a machine for which the drum cartridge 20 is suitable, a specification of the drum cartridge 20, information indicating whether or not a brand-new product, and information about a lifetime of the photosensitive drum 21, the number of rotations of the photosensitive drum 21, the number of printed sheets, an error hysteresis and the like may be stored, in addition to the drum identification information and the specification of the original point sensor 50.

The developing cartridge 30 can be detachably mounted to the drum cartridge 20. In the developing cartridge 30, toner, which is a developing agent, is accommodated. The four developing cartridges 30 accommodate therein toners of different colors (for example, cyan, magenta, yellow and black), respectively. Also, the developing cartridge 30 includes a developing roller 31. The developing roller 31 is a cylindrical member. The developing roller 31 is rotatable about a central axis thereof. When the developing cartridge 30 is mounted to the drum cartridge 20, the outer peripheral surface of the photosensitive drum 21 and an outer peripheral surface of the developing roller 31 are contacted to each other. Also, the developing cartridge 30 has a toner memory 32. The toner memory 32 is a storage medium to and from which information can be written and read out. As the toner memory 32, for example, a flash ROM or an EEPROM is used.

In the toner memory 32, information about the developing cartridge 30 is stored. Specifically, in the toner memory 32, at least toner identification information (for example, serial number) capable of identifying each developing cartridge 30 is stored. Also, in the toner memory 32, worked time of the developing cartridge 30 is stored. The work time is a total period of time for which the developing cartridge 30 actually operates. Also, in the toner memory 32, color information of toner, information indicating whether or not a brand-new product, and information about a lifetime of the developing roller 31, the number of rotations of the developing roller 31, a used amount of toner, an error hysteresis and the like may be stored, in addition to the toner identification information and the worked time.

The drum cartridge 20 to which the developing cartridge 30 is mounted is mounted to the frame 11 in a state where the cover 12 is arranged in the opened position. At this time, the drum cartridge 20 having the developing cartridge 30 mounted thereto is inserted into the cartridge holder 13 through the opening 130.

The light source unit 40 is arranged in a position facing the surface of the photosensitive drum 21 in a state where the drum cartridge 20 is mounted to the frame 11. The light source unit 40 may be fixed to the frame 11 or may be attached to the cover 12. In the case that the light source unit 40 is attached to the cover 12, when the cover 12 is arranged in the closed position, the light source unit 40 is positioned with respect to the photosensitive drum 21. The light source unit 40 has a plurality of light sources 41. The plurality of light sources 41 is aligned in parallel with a rotary shaft of the photosensitive drum 21 along the surface of the photosensitive drum 21. As the light source 41, for example, an LED (light-emitting diode) is used. The light source unit 40 is electrically connected to the control unit 80. Each light source 41 of the light source unit 40 emits light, in response to a command from the control unit 80. Thereby, light is irradiated from the light source 41 toward the outer peripheral surface of the photosensitive drum 21. As a result, the photosensitive material on the outer peripheral surface of the photosensitive drum 21 is exposed.

The original point sensor 50 is a sensor configured to measure a rotation period of the photosensitive drum 21. The original point sensor 50 may be provided to the frame 11 or the drum cartridge 20. The original point sensor 50 is electrically connected to the control unit 80. As the original point sensor 50, for example, a photo sensor is used. A gear, which is rotatable in synchronization with the photosensitive drum 21 or the photosensitive drum 21, is formed with a marking that can be detected by the original point sensor 50. The original point sensor 50 measures a rotation period of the photosensitive drum 21 by detecting the marking. The original point sensor 50 is configured to output a detection signal corresponding to the rotation period to the control unit 80.

The transfer belt 60 is a belt which is movable while being in contact with the photosensitive drum 21. The transfer belt 60 has an annular shape, and is stretched between two pulleys 61. The two pulleys 61 rotate, in response to a command from the control unit 80. The outer peripheral surface of the photosensitive drum 21 and an outer surface of the transfer belt 60 are in contact with each other. During printing processing, a print sheet is conveyed between the transfer belt 60 and the photosensitive drum 21.

The image sensor 70 is arranged in a position in which it faces the outer surface of the transfer belt 60. The image sensor 70 is configured to read a toner image formed on the outer surface of the transfer belt 60 during resister pitch measuring processing, which will be described later. As the image sensor 70, for example, a digital camera having an imaging element such as a CCD and a CMOS is used. The image sensor 70 is configured to capture the outer surface of the transfer belt 60, and outputs the acquired image to the control unit 80.

The control unit 80 is, for example, a circuit board. The control unit 80 includes a processor 81 such as a CPU, and a main body memory 82. The main body memory 82 is a storage medium to and from which information can be written and read out. As the main body memory 82, for example, a flash ROM or an EEPROM is used. In the main body memory 82, a computer program for controlling operations of the image forming apparatus 1 is stored. Also, in the main body memory 82, the drum identification information and the toner identification information can be stored. Also, in the main body memory 82, the specification of the original point sensor 50 can be stored. Also, in the main body memory 82, a drum exchange flag, a drum unknown flag, and a drum secular change flag can be stored. Each of the drum exchange flag, the drum unknown flag, and the drum secular change flag is binary information of ON and OFF to be used in processing, which will be described later. The processor 81 is configured to execute a variety of processing, in accordance with the computer program. The processing that is to be executed by the processor 81 includes first readout processing, second readout processing, third readout processing, toner determination processing, toner-worked time determination processing, drum determination processing, resister pitch measuring processing, and printing processing, which will be described later.

Figure 2:
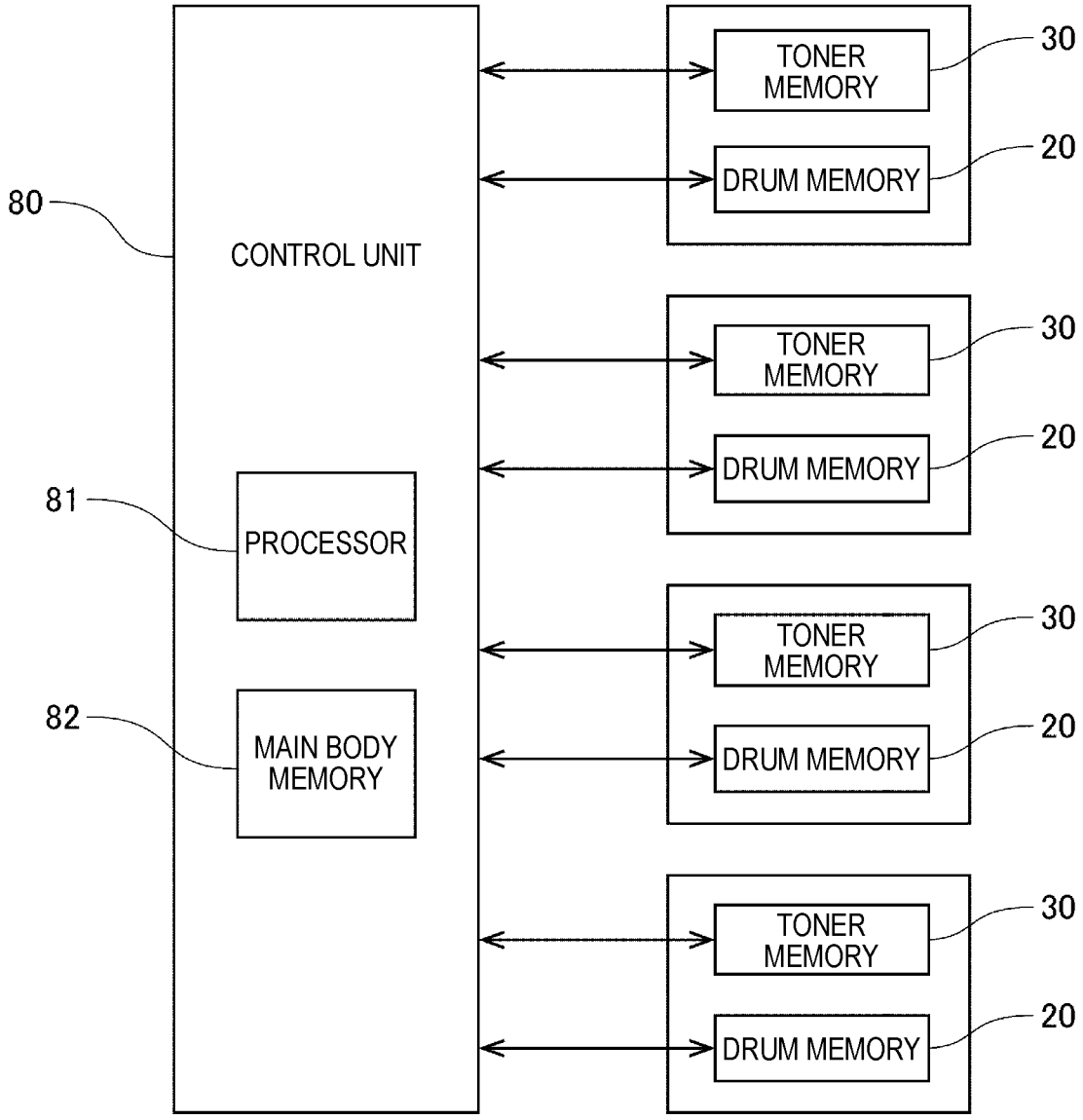
FIG. 2 is a block diagram depicting connection among a control unit, a drum memory and a toner memory.

FIG. 2 is a block diagram depicting connection among the control unit 80, the drum memory 22 and the toner memory 32 when the drum cartridge 20 having the developing cartridge 30 mounted thereto is mounted to the frame 11. When the drum cartridge 20 having the developing cartridge 30 mounted thereto is mounted to the frame 11, the drum memory 22 is electrically connected to the control unit 80 via an electrical connector provided to the frame 11. Thereby, the processor 81 can read out information from the drum memory 22 and write information to the drum memory 22. Also, when the drum cartridge 20 having the developing cartridge 30 mounted thereto is mounted to the frame 11, the toner memory 32 is electrically connected to the control unit 80 via the electrical connector provided to the frame 11. Thereby, the processor 81 can read out information from the toner memory 32 and write information to the toner memory 32. In the meantime, the toner memory 32 may be electrically connected to the control unit 80 via the drum memory 22.

The image forming apparatus 1 drives a motor (not shown) when executing printing processing. The photosensitive drum 21 and the developing roller 31 rotate by drive force supplied from the motor. Also, the plurality of light sources 41 emits light, in response to a command from the control unit 80. Thereby, an electrostatic latent image corresponding to an image to be printed is formed on the outer peripheral surface of the photosensitive drum 21. The toner supplied from the developing cartridge 30 is supplied to the electrostatic latent image on the photosensitive drum 21, via the developing roller 31. Thereby, the electrostatic latent image on the outer peripheral surface of the photosensitive drum 21 becomes visible. Then, the print sheet is conveyed between the photosensitive drum 21 and the transfer belt 60. Thereby, the toner is transferred from the outer peripheral surface of the photosensitive drum 21 to the print sheet. As a result, an image is printed on the print sheet.

<2. Processing in Image Forming Apparatus>

Subsequently, processing is described which is executed by the control unit 80 when a power supply of the image forming apparatus 1 is switched from an off state to an on state or when the opening 130 is switched from the opened state to the closed state in a state where the power supply of the image forming apparatus 1 is on. FIGS. 3 to 7 are flowcharts depicting flows of the processing.

In descriptions below, it is assumed that the drum cartridge 20 having the developing cartridge 30 mounted thereto is mounted to the frame 1 when the power supply of the image forming apparatus 1 is switched from the off state to the on state or when the opening 130 is switched from the opened state to the closed state in the state where the power supply of the image forming apparatus 1 is on. Also, in descriptions below, the processing for one set of the drum cartridge 20 and the developing cartridge 30 is described. However, the control unit 80 executes the same processing for the four sets of the drum cartridges 20 and the developing cartridges 30.

Figure 3:
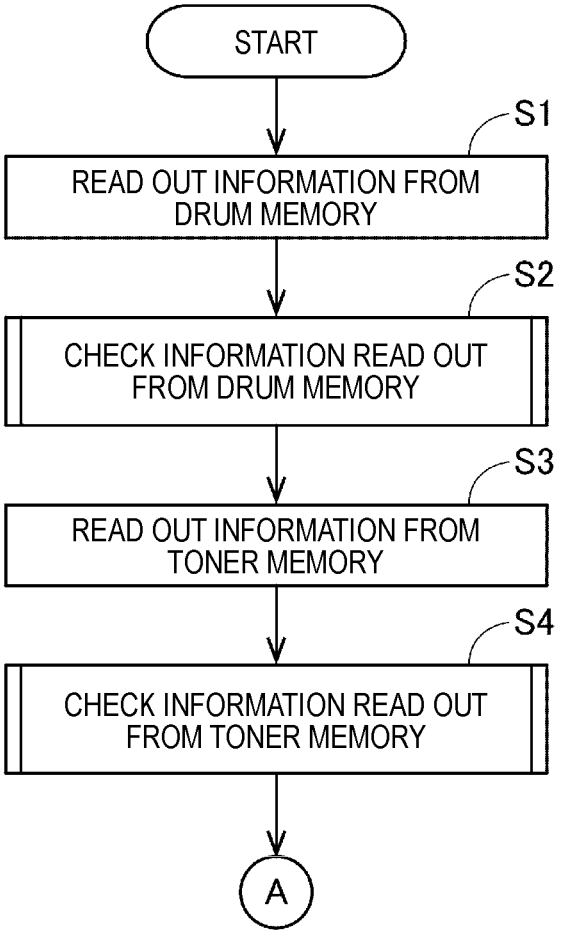
FIG. 3 is a flowchart depicting flow of processing that is to be executed by the control unit.

As shown in FIG. 3, the control unit 80 first reads out necessary information from the drum memory 22 of the drum cartridge 20 (step S1). Specifically, the control unit 80 reads out the drum identification information from the drum memory 22 (first readout processing). Also, the control unit 80 reads out the worked time of the drum cartridge 20 from the drum memory 22 (third readout processing). Then, the control unit 80 checks the information read out from the drum memory 22 (step S2).

Figure 8:
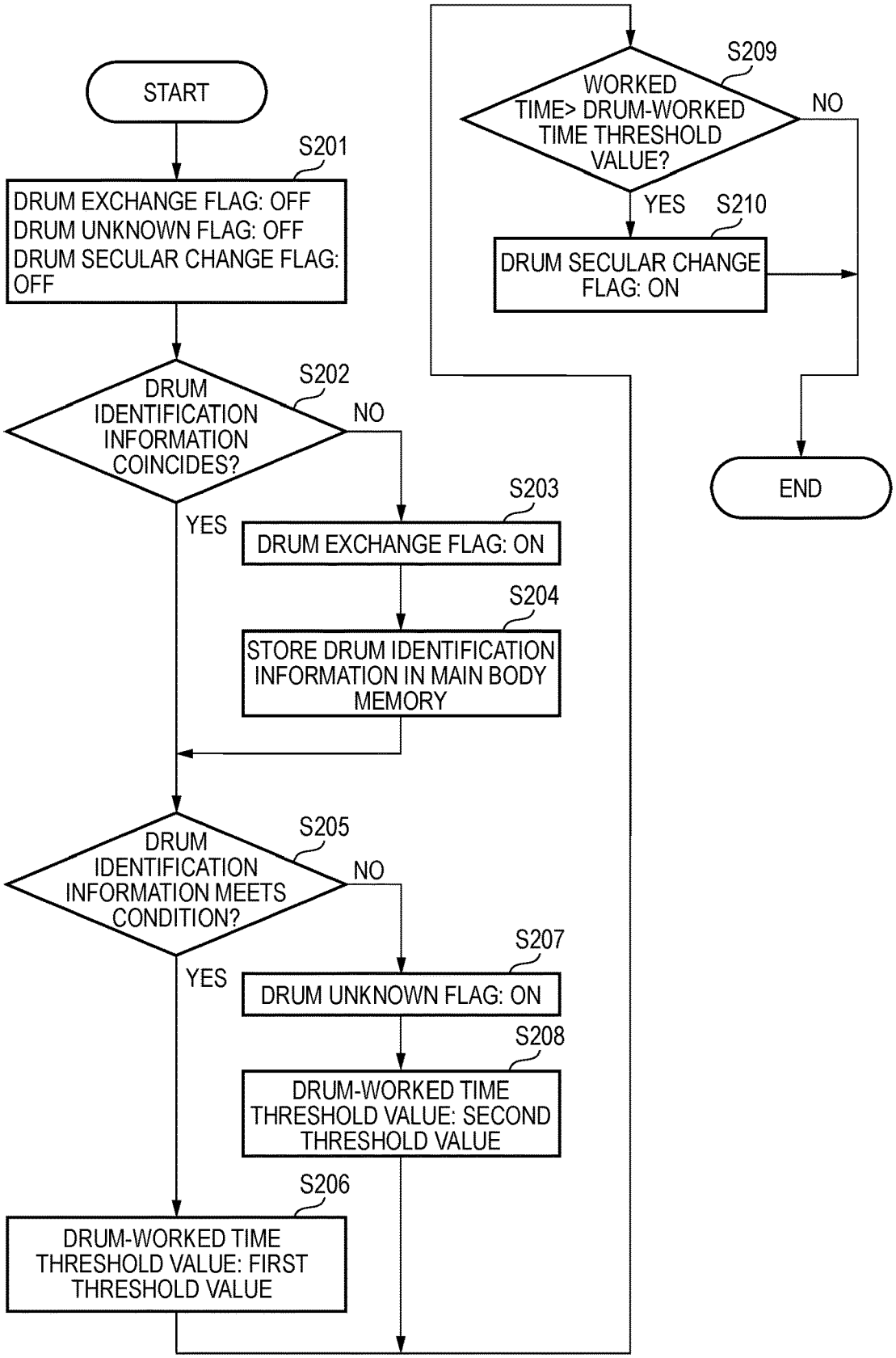
FIG. 8 is a flowchart depicting flow of processing of checking information read out from the drum memory.

FIG. 8 is a flowchart depicting the processing of step S2 in detail. As shown in FIG. 8, the control unit 80 first sets the drum exchange flag, the drum unknown flag, and the drum secular change flag stored in the main body memory 82 to OFF (step S201).

Then, the control unit 80 determines whether the drum identification information read out from the drum memory 22 coincides with the drum identification information stored in the main body memory 82 (step S202, drum determination processing).

In the main body memory 82, the drum identification information of the drum cartridge 20 mounted to the frame 11 is stored before the power supply becomes off or the cover 12 is opened. For this reason, when the drum cartridge 20 has not been exchanged, the drum identification information read out from the drum memory 22 and the drum identification information stored in the main body memory 82 coincide with each other. When the control unit 80 determines that the drum identification information read out from the drum memory 22 coincides with the drum identification information stored in the main body memory 82 (step S202: yes), the control unit 80 proceeds to processing of step S205 without executing processing of steps S203 to S204.

On the other hand, when the drum cartridge 20 is exchanged, the drum identification information read out from the drum memory 22 and the drum identification information stored in the main body memory 82 do not coincide with each other. When the control unit 80 determines that the drum identification information read out from the drum memory 22 does not coincide with the drum identification information stored in the main body memory 82 (step S202: no), the control unit 80 sets the drum exchange flag stored in the main body memory 82 to ON (step S203). Then, the control unit 80 deletes the drum identification information stored in the main body memory 82, and stores the drum identification information read out from the drum memory 22 in the main body memory 82 (step S204). Thereafter, the control unit 80 proceeds to processing of step S205.

Then, the control unit 80 determines whether the drum identification information read out from the drum memory 22 meets a predetermined condition (step S205). In the main body memory 82 of the control unit 80, a condition meeting the specific drum identification information is stored in advance. In step S205, the control unit 80 determines whether the drum identification information read out from the drum memory 22 meets the condition stored in the main body memory 82.

When the control unit 80 determines that the drum identification information meets the condition (step S205: yes), the control unit 80 sets a drum-worked time threshold value stored in the main body memory 82, to a first threshold value (step S206). The drum-worked time threshold value is a threshold value that is to be used in next processing of step S209. Then, the control unit 80 proceeds to processing of step S209.

On the other hand, when the control unit 80 determines that the drum identification information read out from the drum memory 22 does not meet the condition stored in the main body memory 82 (step S205: no), the control unit 80 sets the drum unknown flag stored in the main body memory 82 to ON (step S207). Then, the control unit 80 sets the drum-worked time threshold value stored in the main body memory 82, to a second threshold value smaller than the first threshold value (step S208). Then, the control unit 80 proceeds to processing of step S209.

Then, the control unit 80 determines whether the worked time of the dram cartridge 20 read out from the drum memory 22 is longer than the drum-worked time threshold value (first threshold value or second threshold value) stored in the main body memory 82 (step S209, drum-worked time determination processing).

When the control unit 80 determines that the worked time of the dram cartridge 20 read out from the drum memory 22 is equal to or shorter than the drum-worked time threshold value (step S209: no), the control unit 80 proceeds to processing of step S3 without executing processing of step S210. On the other hand, when the control unit 80 determines that the worked time of the dram cartridge 20 read out from the drum memory 22 is longer than the drum-worked time threshold value (step S209: yes), the control unit 80 sets the drum secular change flag stored in the main body memory 82 to ON (step S210).

Returning to FIG. 3, when the processing of step S2 is finished, the control unit 80 reads out necessary information from the toner memory 32 of the developing cartridge 30 (step S3). Specifically, the control unit 80 reads out the toner identification information from the toner memory 32 (second readout processing). Also, the control unit 80 reads out the worked time of the developing cartridge 30 from the toner memory 32 (fourth readout processing). Then, the control unit 80 checks the information read out from the toner memory 32 (step S4).

Figure 9:
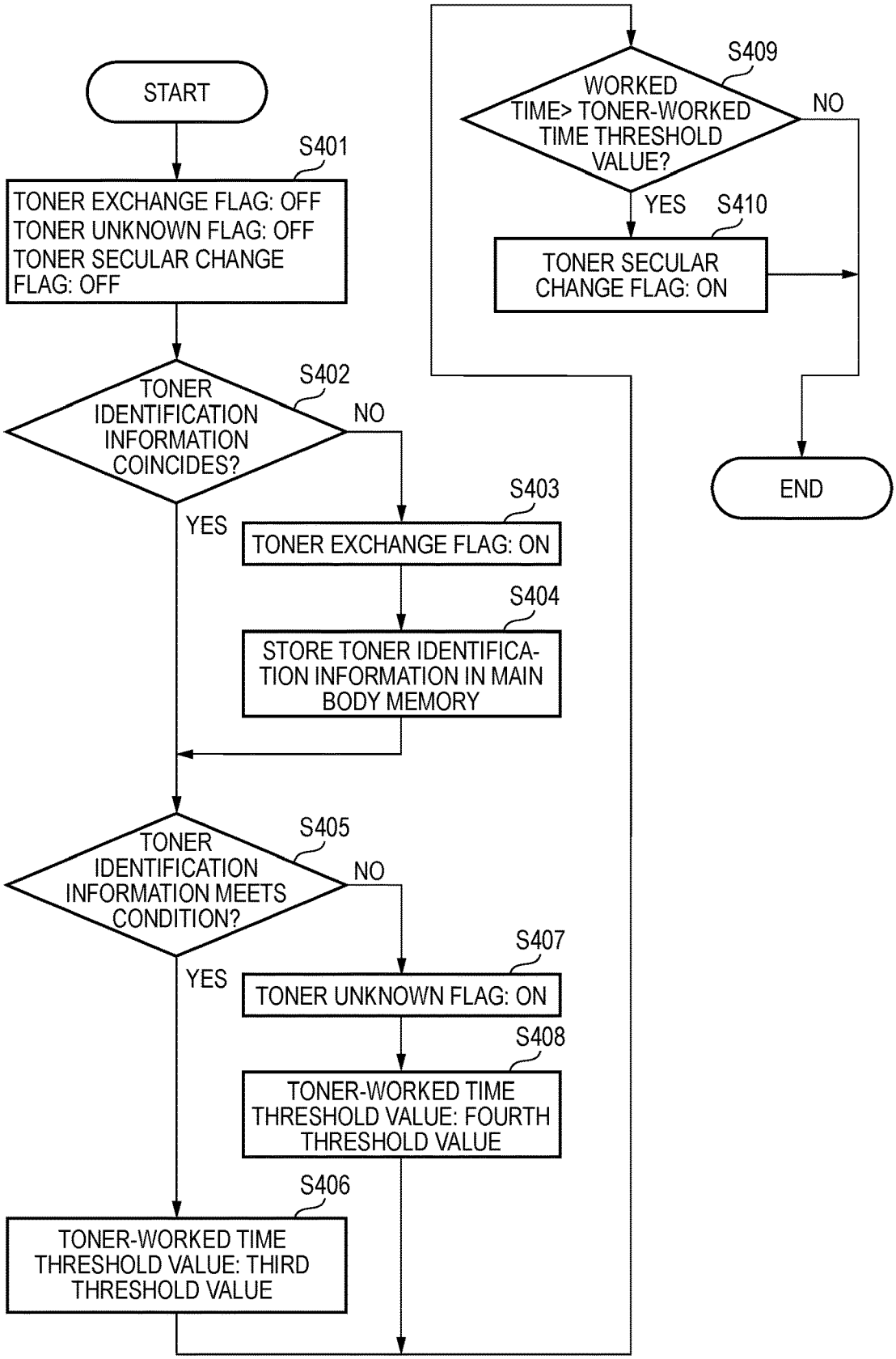
FIG. 9 is a flowchart depicting flow of processing of checking information read out from the toner memory.

FIG. 9 is a flowchart depicting the processing of step S4 in detail. As shown in FIG. 9, the control unit 80 first sets the toner exchange flag, the toner unknown flag, and the toner secular change flag stored in the main body memory 82 to OFF (step S401).

Then, the control unit 80 determines whether the toner identification information read out from the toner memory 32 coincides with the toner identification information stored in the main body memory 82 (step S402, toner determination processing).

In the main body memory 82, the toner identification information of the developing cartridge 30 mounted to the frame 11 is stored before the power supply becomes off or the cover 12 is opened. For this reason, when the developing cartridge 30 is not exchanged, the toner identification information read out from the toner memory 32 and the toner identification information stored in the main body memory 82 coincide with each other. When the control unit 80 determines that the drum identification information read out from the toner memory 32 coincides with the toner identification information stored in the main body memory 82 (step S402: yes), the control unit 80 proceeds to processing of step S405 without executing processing of steps S403 to S404.

On the other hand, when the developing cartridge 30 is exchanged, the toner identification information read out from the toner memory 32 and the toner identification information stored in the main body memory 82 do not coincide with each other. When the control unit 80 determines that the drum identification information read out from the toner memory 32 does not coincide with the toner identification information stored in the main body memory 82 (step S402: no), the control unit 80 sets the toner exchange flag stored in the main body memory 82 to ON (step S403). Then, the control unit 80 deletes the toner identification information stored in the main body memory 82, and stores the toner identification information read out from the toner memory 32, in the main body memory 82 (step S404). Then, the control unit 80 proceeds to processing of step S405.

Then, the control unit 80 determines whether the toner identification information read out from the toner memory 32 meets a predetermined condition (step S405). In the main body memory 82 of the control unit 80, a condition meeting the specific toner identification information is stored in advance. In step S405, the control unit 80 determines whether the toner identification information read out from the toner memory 32 meets the condition stored in the main body memory 82.

When the control unit 80 determines that the toner identification information meets the condition (step S405: yes), the control unit 80 sets a toner-worked time threshold value stored in the main body memory 82 to a third threshold value (step S406). The toner-worked time threshold value is a threshold value that is to be used in processing of step S409. Thereafter, the control unit 80 proceeds to processing of step S409.

On the other hand, when the control unit 80 determines that the toner identification information read out from the toner memory 32 does not meet the condition stored in the main body memory 82 (step S405: no), the control unit 80 sets the toner unknown flag stored in the main body memory 82 to ON (step S407). Then, the control unit 80 sets the toner-worked time threshold value stored in the main body memory 82 to a fourth threshold value smaller than the third threshold value (step S408). Then, the control unit 80 proceeds to processing of step S409.

Then, the control unit 80 determines whether the worked time of the developing cartridge 30 read out from the toner memory 32 is longer than the toner-worked time threshold value (third threshold value or fourth threshold value) stored in the main body memory 82 (step S409, toner-worked time determination processing).

When the control unit 80 determines that the worked time of the developing cartridge 30 read out from the toner memory 32 is equal to or shorter than the toner-worked time threshold value (step S409: no), the control unit 80 proceeds to processing of step S5 without executing processing of step S410. On the other hand, when the control unit 80 determines that the worked time of the developing cartridge 30 read out from the toner memory 32 is longer than the toner-worked time threshold value (step S409: yes), the control unit 80 sets the toner secular change flag stored in the main body memory 82 to ON (step S410).

Meanwhile, in the exemplary embodiment, the control unit 80 first checks the information read out from the drum memory 22 (step S2) and then checks the information read out from the toner memory 32 (step S4). However, the control unit 80 may first check the information read out from the toner memory 32 (step S4) and then check the information read out from the drum memory 22 (step S2). Also, the control unit 80 may first read out the information from the drum memory 22 and the toner memory 32 (steps S1 and S3) and then check each of the read information (steps S2 and S4).

Figure 4:
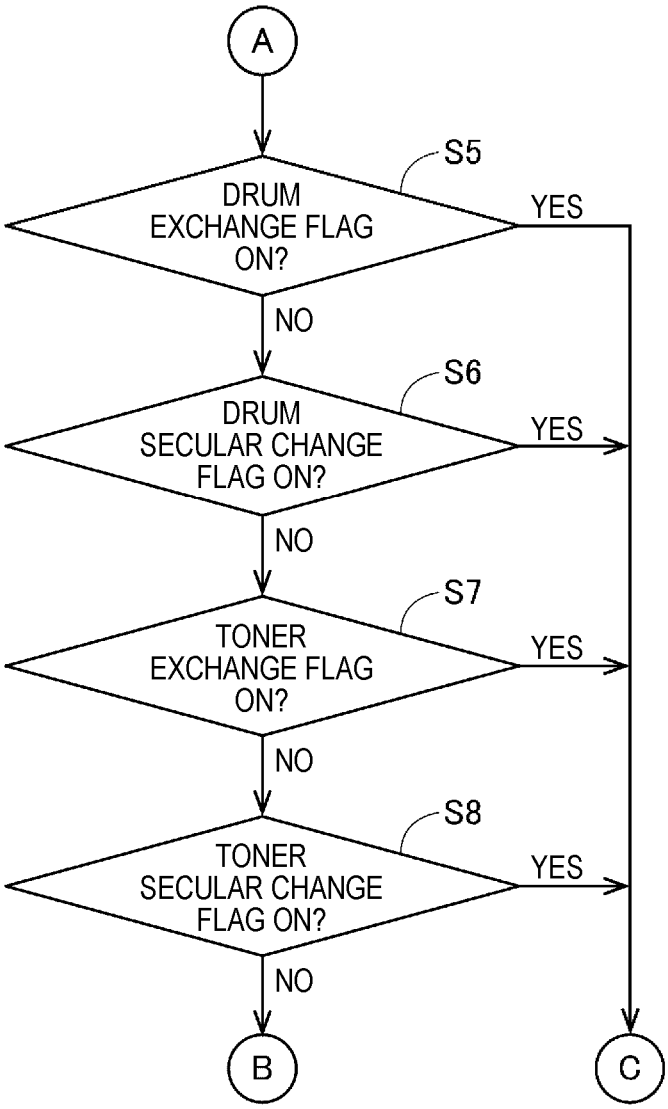
FIG. 4 is a flowchart depicting flow of processing that is to be executed by the control unit.
Figure 5:
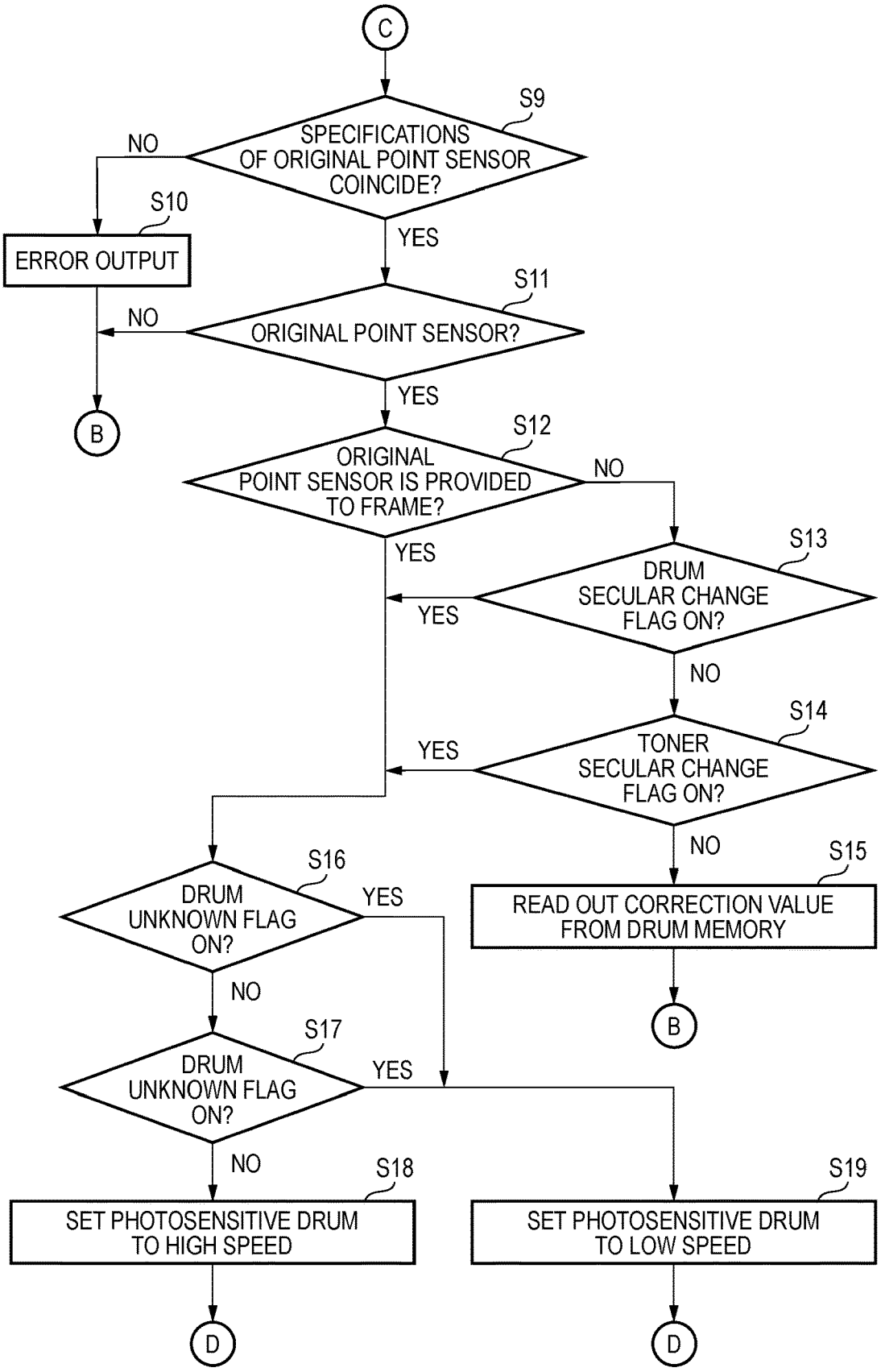
FIG. 5 is a flowchart depicting flow of processing that is to be executed by the control unit.
Figure 6:
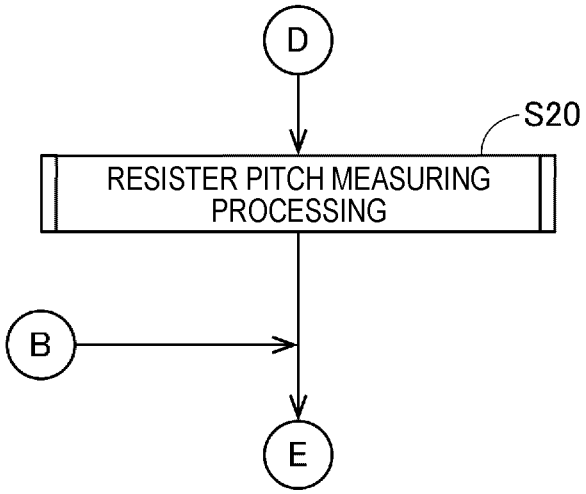
FIG. 6 is a flowchart depicting flow of processing that is to be executed by the control unit.

When the processing of step S1 to S4 is finished, the control unit 80 determines whether the drum exchange flag stored in the main body memory 82 is ON (step S5), as shown in FIG. 4. When the control unit 80 determines that the drum exchange flag is ON (step S5: yes), the control unit 80 proceeds to processing of step S9. On the other hand, when the control unit 80 determines that the drum exchange flag is OFF (step S5: no), the control unit 80 determines whether the drum secular change flag stored in the main body memory 82 is ON (step S6). When the control unit 80 determines that the drum secular change flag is ON (step S6: yes), the control unit 80 proceeds to processing of step S9.

On the other hand, when the control unit 80 determines that the drum secular change flag is OFF (step S6: no), the control unit 80 determines whether the toner exchange flag stored in the main body memory 82 is ON (step S7). When the control unit 80 determines that the toner exchange flag is ON (step S7: yes), the control unit 80 proceeds to processing of step S9. On the other hand, when the control unit 80 determines that the toner exchange flag is OFF (step S7: no), the control unit 80 determines whether the toner secular change flag stored in the main body memory 82 is ON (step S8). When the control unit 80 determines that the toner secular change flag is ON (step S8: yes), the control unit 80 proceeds to processing of step S9. On the other hand, when the control unit 80 determines that the toner secular change flag is OFF (step S8: no), the control unit 80 proceeds to processing of step S21.

That is, when the control unit 80 determines that at least one of the drum exchange flag, the drum secular change flag, the toner exchange flag and the toner secular change flag stored in the main body memory 82 is ON, the control unit 80 proceeds to processing of step S9. On the other hand, when the control unit 80 determines that the drum exchange flag, the drum secular change flag, the toner exchange flag and the toner secular change flag stored in the main body memory 82 are all OFF, the control unit 80 proceeds to processing of step S21 without executing resister pitch measuring processing of step S20, which will be described later.

In the meantime, the sequence of the determination processing of steps S6, S7, S8 and S9 may be different from FIG. 4.

Then, the control unit 80 reads out the specification of the original point sensor 50 from the drum memory 22. Then, the control unit 80 determines whether the specification of the original point sensor 50 read out from the drum memory 22 and the specification of the main body memory 82 stored in the original point sensor 50 coincide with each other (step S9). Here, the specification of the original point sensor 50 includes information indicating whether or not the original point sensor 50 and information indicating whether the original point sensor 50 is provided to the frame 11 or the drum cartridge 20.

When the control unit 80 determines that the specification of the original point sensor 50 read out from the drum memory 22 and the specification of the original point sensor 50 stored in the main body memory 82 do not coincide with each other (step S9: no), the control unit 80 outputs an error (step S10). Specifically, the control unit 80 displays an error message on the display 90. However, the control unit 80 may output the error in a different aspect, such as a voice output. After outputting the error, the control unit 80 proceeds to processing of step S21 without executing resister pitch measuring processing of step S20.

On the other hand, when the control unit 80 determines that the specification of the original point sensor 50 read out from the drum memory 22 and the specification of the original point sensor 50 stored in the main body memory 82 coincide with each other (step S9: yes), the control unit 80 determines whether there is the original point sensor 50 (step S11). Specifically, the control unit 80 determines whether there is the original point sensor 50, based on the information indicating whether or not the original point sensor 50, which is included in the specification of the drum memory 22 read out from the original point sensor 50 or the specification of the original point sensor 50 stored in the main body memory 82.

When there is no original point sensor 50, the image forming apparatus 1 cannot execute resister pitch measuring processing in which the original point sensor 50 is to be used. For this reason, when the control unit 80 determines that there is no original point sensor 50 (step S11: no), the control unit 80 proceeds to processing of step S21 without executing resister pitch measuring processing of step S20, which will be described later.

On the other hand, when the control unit 80 determines that there is the original point sensor 50 (step S11: yes), the control unit 80 determines whether the original point sensor 50 is provided to the frame 11 (step S12). Specifically, the control unit 80 determines whether the original point sensor 50 is provided to the frame 11, based on the specification of the drum memory 22 read out from the original point sensor 50 or the specification of the original point sensor 50 stored in the main body memory 82.

When the control unit 80 determines that the original point sensor 50 is provided to the frame 11 (step S12: yes), the control unit 80 proceeds to processing of step S16.

On the other hand, when the control unit 80 determines that the original point sensor 50 is not provided to the frame 11 (i.e., the original point sensor 50 is provided to the drum cartridge 20) (step S12: no), the control unit 80 determines whether the drum secular change flag stored in the main body memory 82 is ON (step S13). When the control unit 80 determines that the drum secular change flag is ON (step S13: yes), the control unit 80 proceeds to processing of step S16. Also, when the control unit 80 determines that the drum secular change flag is OFF (step S13: no), the control unit 80 determines whether the toner secular change flag stored in the main body memory 82 is ON (step S14). When the control unit 80 determines that the toner secular change flag is ON (step S14: yes), the control unit 80 proceeds to processing of step S16. Also, when the control unit 80 determines that the toner secular change flag is OFF (step S14: no), the control unit 80 proceeds to processing of step S15.

When the original point sensor 50 is provided to the drum cartridge 20, not the frame 11, a positional relation between the original point sensor 50 and the photosensitive drum 21 is difficult to change. For this reason, it is less necessary to execute resister pitch measuring processing of step S20, which will be described later. In this case, in the drum memory 22, a correction value corresponding to variations in printing pitch due to the shape of the outer peripheral surface of the photosensitive drum 21 is stored in advance. When the control unit 80 determines that the original point sensor 50 is not provided to the frame 11 (step S12: no), the drum secular change flag is OFF (step S13: no), and the toner secular change flag is OFF (step S14: no), the control unit 80 reads out the correction value from the drum memory 22 (step S15). Then, the control unit 80 proceeds to processing of step S21 without executing resister pitch measuring processing of step S20, which will be described later.

On the other hand, when the original point sensor 50 is provided to the frame 11, there is a possibility that the positional relation between the original point sensor 50 and the photosensitive drum 21 will change. For this reason, it is highly necessary to execute resister pitch measuring processing of step S20, which will be described later. Also, even in the case that the original point sensor 50 is provided to the drum cartridge 20, when the drum cartridge 20 or the developing cartridge 30 is used over a long time period, it is highly necessary to execute resister pitch measuring processing of step S20. For this reason, when the control unit 80 determines that the original point sensor 50 is provided to the frame 11 (step S12: yes) or that at least one of the drum secular change flag and the toner secular change flag is ON (step S13 to S14: no), the control unit 80 executes resister pitch measuring processing of step S20 via processing of steps S16 to S19.

In step S16, the control unit 80 determines whether the drum unknown flag stored in the main body memory 82 is ON (step S16). When the control unit 80 determines that the drum unknown flag is OFF (step S16: no), the control unit 80 determines whether the toner unknown flag is ON (step S17). When the control unit 80 determines that the toner unknown flag is OFF (step S17: no), the control unit 80 sets a rotating speed of the photosensitive drum 21 to be faster than a rotating speed of the photosensitive drum 21 during printing processing (step S18). In the main body memory 82, a high-speed parameter for rotating the photosensitive drum 21 at high speed is stored in advance. In step S18, the control unit 80 reads out the high-speed parameter from the main body memory 82.

On the other hand, when the control unit 80 determines that the drum unknown flag is ON (step S16: yes) or the toner unknown flag is ON (step S17: yes), the control unit 80 sets a rotating speed of the photosensitive drum 21 to be lower than a rotating speed of the photosensitive drum 21 during printing processing (step S19). In the main body memory 82, a low-speed parameter for rotating the photosensitive drum 21 at low speed is stored in advance. The control unit 80 reads out the low-speed parameter from the main body memory 82.

Then, the control unit 80 drives the motor, which is a drive source of the photosensitive drum 21, based on the read high-speed parameter or low-speed parameter. Thereby, the control unit 80 rotates the photosensitive drum 21 at high speed or low speed and executes resister pitch measuring processing (step S20). The resister pitch measuring processing is processing of measuring variations in printing pitch due to the shape of the outer peripheral surface of the photosensitive drum 21.

Figure 10:
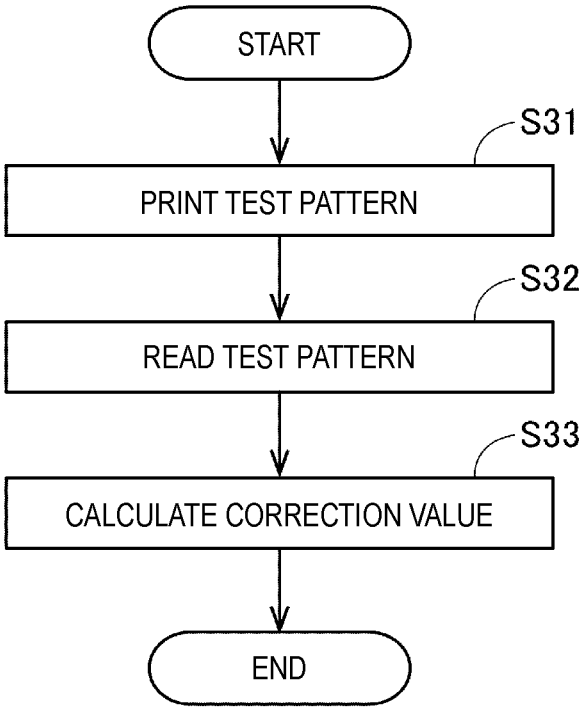
FIG. 10 is a flowchart depicting resister pitch measuring processing in detail.

FIG. 10 is a flowchart depicting the resister pitch measuring processing in detail. As shown in FIG. 10, when executing the resister pitch measuring processing, the control unit 80 first executes printing processing of a test pattern (step S31). Specifically, the control unit 80 operates the photosensitive drum 21, the developing roller 31, and the transfer belt 60, and causes the plurality of light sources 41 of the light source unit 40 to emit light, in accordance with the test pattern. Thereby, the test pattern is formed on the outer surface of the transfer belt 60 by toner. The test pattern is a pattern in which figures are aligned with predetermined intervals in a moving direction of the transfer belt 60, for example.

Then, the control unit 80 causes the image sensor 70 to read the test pattern (step S32). The image sensor 70 reads the test pattern printed on the transfer belt 60, and outputs an image of the test pattern to the control unit 80. Also, the original point sensor 50 detects the marking formed on the photosensitive drum 21 or the gear, and outputs a detection signal to the control unit 80.

Thereafter, the control unit 80 calculates a correction value corresponding to the variations in printing pitch, based on the detection signal of the original point sensor 50 and the image acquired from the image sensor 70 (step S33). Specifically, the control unit 80 calculates the correction value, based on an amount of positional deviation of each figure in the image of the test pattern, in one rotation period of the photosensitive drum 21 indicated by the detection signal of the original point sensor 50. Then, the control unit 80 stores the calculated correction value in the main body memory 82.

Figure 7:
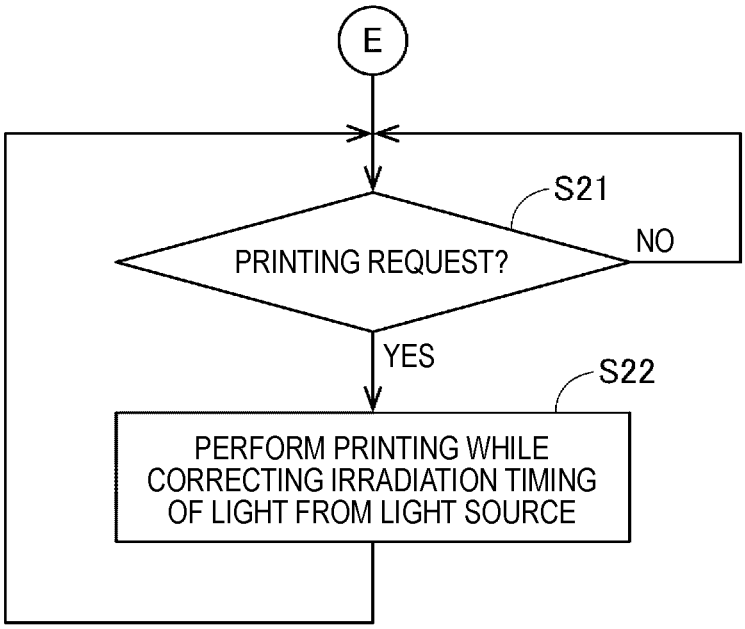
FIG. 7 is a flowchart depicting flow of processing that is to be executed by the control unit.

Then, the control unit 80 is in a standby state in which it waits for an input of a printing request. As shown in FIG. 7, in the standby state, the control unit 80 determines whether there is an input of a printing request (step S21). When the control unit 80 determines that there is no input of a printing request (step S21: no), the control unit 80 continues to determine whether there is an input of a printing request (step S21).

When the control unit 80 determines that the control unit 80 receives an input of a printing request (step S21: yes), the control unit 80 executes printing processing (step S22). Specifically, the control unit 80 operates the photosensitive drum 21, the developing roller 31, and the transfer belt 60, and causes the plurality of light sources 41 of the light source unit 40 to emit light while conveying the print sheet. Thereby, an image is formed on a surface of the print sheet by the toner.

At this time, the control unit 80 corrects an irradiation timing of light from the light source 41, based on the correction value stored in the main body memory 82. Specifically, the control unit 80 accelerates or delays a light-emitting timing of the light source 41 by short time corresponding to the correction value. Thereby, the variations in printing pitch due to the shape of the outer peripheral surface of the photosensitive drum 21 is corrected. As a result, it is possible to obtain a high-quality printed image in which the variations in printing pitch due to the shape of the outer peripheral surface of the photosensitive drum 21 is suppressed.

When the printing processing of step S22 is finished, the control unit 80 returns to step S21, and is again in the standby state in which it waits for receiving an input of a printing request.

As described above, according to the image forming apparatus 1, when the control unit 80 determines that the drum identification information read out from the drum memory 22 coincides with the drum identification information stored in the main body memory 82, the control unit 80 sets the drum exchange flag to OFF. When the control unit 80 determines that the drum exchange flag is OFF, the control unit 80 may not execute the resister pitch measuring processing. The reason is that when the drum cartridge 20 has not been exchanged, it is less necessary to execute the resister pitch measuring processing. Thereby, it is possible to shorten the operating time of the image forming apparatus 1, which is required for the resister pitch measuring processing. Also, the resister pitch measuring processing is not executed, so that it is possible to reduce an amount of toner consumption.

Also, according to the image forming apparatus 1, when the control unit 80 determines that the toner identification information read out from the toner memory 32 coincides with the toner identification information stored in the main body memory 82, the control unit 80 sets the toner exchange flag to OFF. When the control unit 80 determines that the toner exchange flag is OFF, the control unit 80 may not execute the resister pitch measuring processing. The reason is that when the developing cartridge 30 has not been exchanged, it is less necessary to execute the resister pitch measuring processing. Thereby, it is possible to shorten the operating time of the image forming apparatus 1. Also, the resister pitch measuring processing is not executed, so that it is possible to reduce an amount of toner consumption.

Also, according to the image forming apparatus 1, when the control unit 80 determines that the worked time of the dram cartridge 20 read out from the drum memory 22 is equal to or shorter than the drum-worked time threshold value stored in the main body memory 82, the control unit 80 sets the drum secular change flag to OFF. When the control unit 80 determines that the drum secular change flag is OFF, the control unit 80 may not execute the resister pitch measuring processing. The reason is that when the worked time of the drum cartridge 20 is short, it is less necessary to execute the resister pitch measuring processing. Thereby, it is possible to shorten the operating time of the image forming apparatus 1, which is required for the resister pitch measuring processing. Also, the resister pitch measuring processing is not executed, so that it is possible to reduce an amount of toner consumption.

Also, according to the image forming apparatus 1, when the worked time of the developing cartridge 30 read out from the toner memory 32 is equal to or shorter than the toner-worked time threshold value stored in the main body memory 82, the control unit 80 sets the toner secular change flag to OFF. When the control unit 80 determines that the toner secular change flag is OFF, the control unit 80 may not execute the resister pitch measuring processing. The reason is that when the worked time of the developing cartridge 30 is short, it is less necessary to execute the resister pitch measuring processing. Thereby, it is possible to shorten the operating time of the image forming apparatus 1, which is required for the resister pitch measuring processing. Also, the resister pitch measuring processing is not executed, so that it is possible to reduce an amount of toner consumption.

Also, in the exemplary embodiment, when the control unit 80 determines that both the drum unknown flag and the toner unknown flag are OFF, the control unit 80 executes the resister pitch measuring processing while rotating the photosensitive drum 21 at high speed. Thereby, it is possible to shorten the time required for the resister pitch measuring processing. As a result, it is possible to further shorten the operating time of the image forming apparatus 1.

Also, in the exemplary embodiment, when the control unit 80 determines that at least one of the drum unknown flag and the toner unknown flag is ON, the control unit 80 executes the resister pitch measuring processing while rotating the photosensitive drum 21 at low speed. In the case that at least one of the drum identification information and the toner identification information is not known already, if the resister pitch measuring processing is executed at high speed, the drum cartridge 20, the developing cartridge 30 or the other part of the image forming apparatus 1 may be unexpectedly deteriorated. In this case, the control unit 80 executes the resister pitch measuring processing at low speed, so that it is possible to prevent the drum cartridge 20, the developing cartridge 30 or the other part of the image forming apparatus 1 from being deteriorated.

In the meantime, when at least one of the drum identification information and the toner identification information is not known already, even in the case that the resister pitch measuring processing is executed at low speed, the drum cartridge 20, the developing cartridge 30 or the other part of the image forming apparatus 1 may be unexpectedly deteriorated. For this reason, when the control unit 80 determines that at least one of the drum unknown flag and the toner unknown flag is ON, the control unit 80 may not execute the resister pitch measuring processing.

<3. Modified Embodiments>

Although the exemplary embodiment of the present disclosure has been described, the present disclosure is not limited to the exemplary embodiment. In modified embodiments below, differences from the exemplary embodiment are described.

<3-1. First Modified Embodiment>

Figure 11:
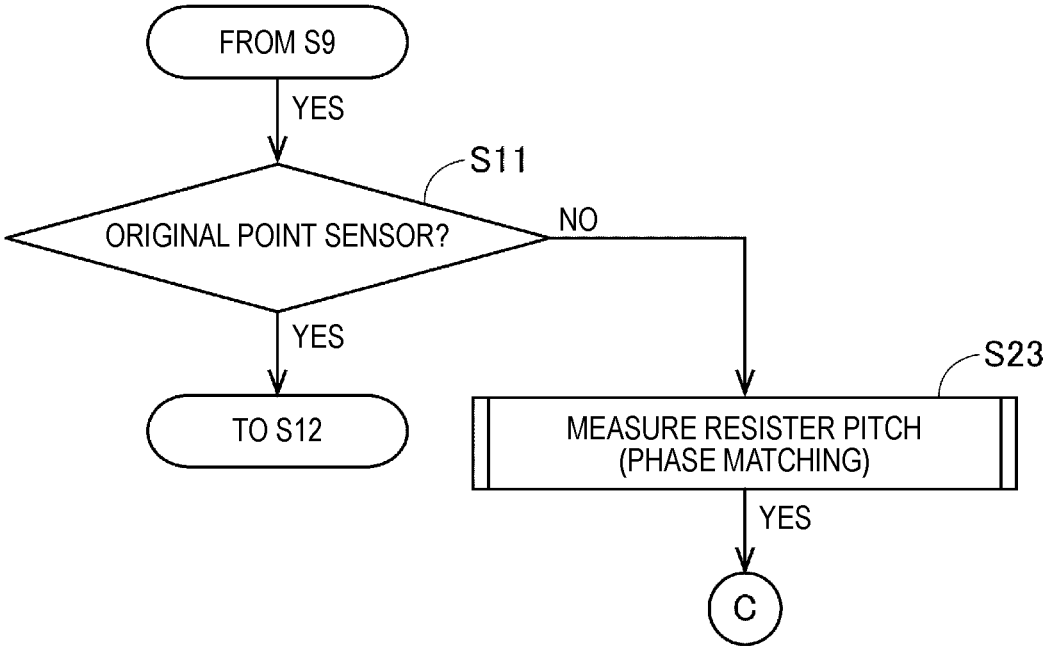
FIG. 11 is a flowchart depicting processing of a first modified embodiment.

FIG. 11 is a flowchart depicting a flow of processing of a first modified embodiment. In the above exemplary embodiment, when the control unit 80 determines in step S11 there is no original point sensor 50, the control unit 80 proceeds to the standby state of step S21 without executing the resister pitch measuring processing. In contrast, in the first modified embodiment, when the control unit 80 determines in step S11 there is no original point sensor 50, the control unit 80 executes resister pitch measuring processing by phase matching (step S23).

The resister pitch measuring processing by the phase matching can be described with reference to FIG. 10, like the above exemplary embodiment. That is, the control unit 80 first executes the printing processing of the test pattern (step S31). Then, the control unit 80 causes the image sensor 70 to read the test pattern (step S32). Then, the control unit 80 detects the rotation period of the photosensitive drum 21 by the phase matching, based on the image of the test pattern acquired by the image sensor 70. Then, the control unit 80 calculates the correction value, based on an amount of positional deviation of each figure in the image of the test pattern, in the detected rotation period (step S33). The control unit 80 stores the calculated correction value in the main body memory 82.

Like this, when the phase matching is used, it is possible to execute the resister pitch measuring processing even in the case that there is no original point sensor 50.

<3-2. Second Modified Embodiment>

Figure 12:
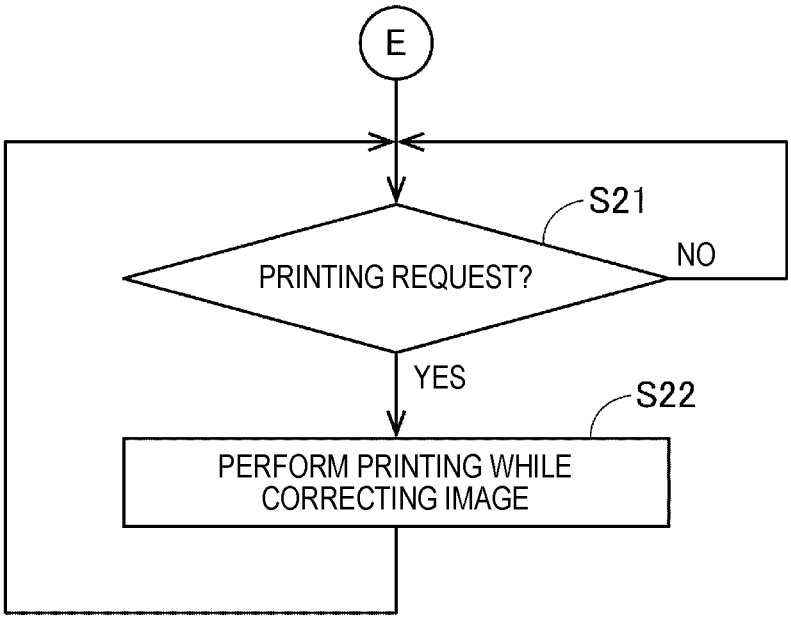
FIG. 12 is a flowchart depicting processing of a second modified embodiment.
Figure 13:
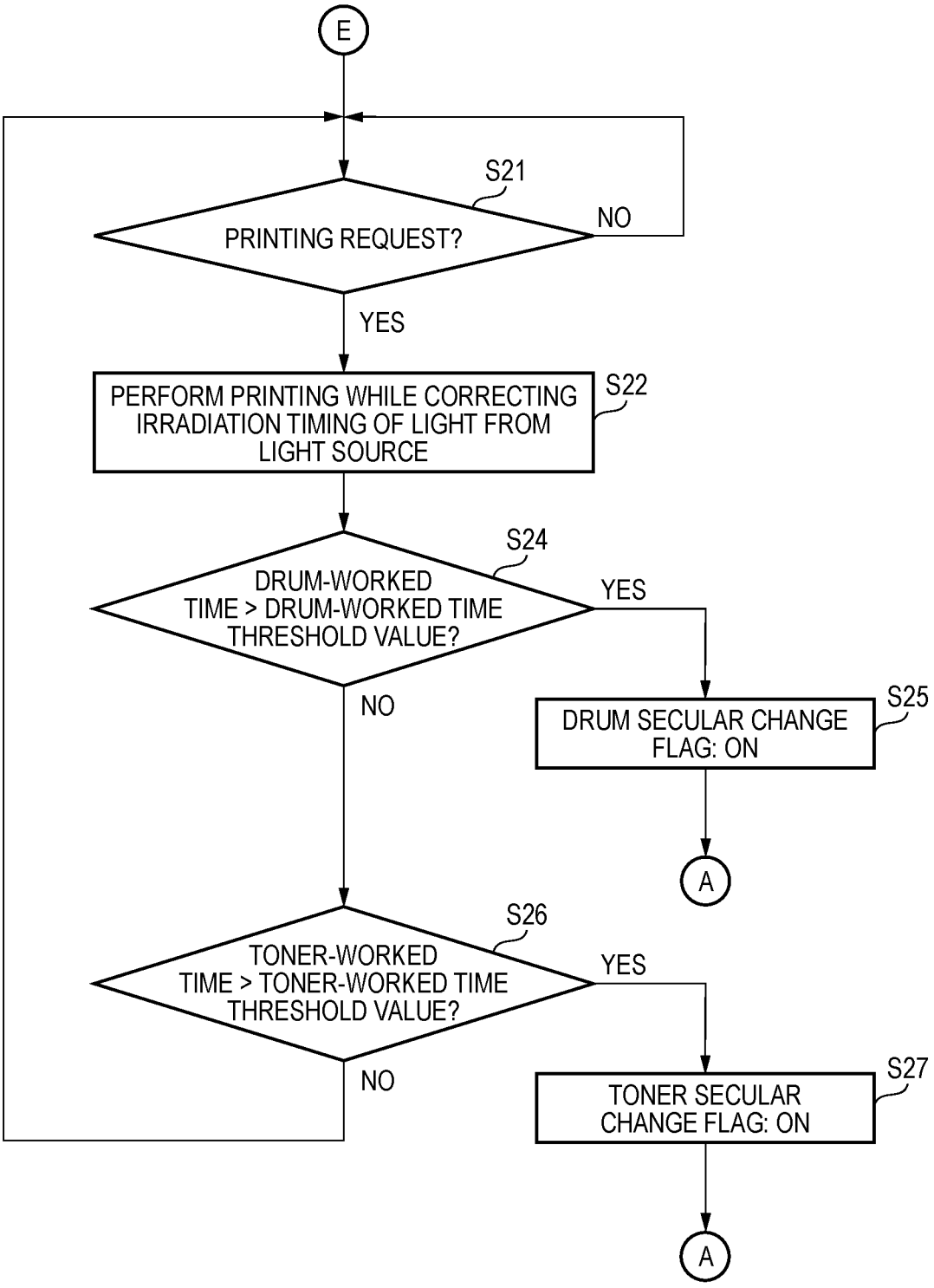
FIG. 13 is a flowchart depicting processing of a third modified embodiment.

FIG. 12 is a flowchart depicting a flow of processing of a second modified embodiment. In the above exemplary embodiment, when executing the printing processing of step S22, the control unit 80 corrects the irradiation timing of light from the light source 41. In contrast, in the second modified embodiment, when executing the printing processing of step S22, the control unit 80 corrects an input image. Specifically, the control unit 80 enlarges or reduces a size of each part of the input image, in correspondence to the correction value. Thereby, the variations in printing pitch due to the shape of the outer peripheral surface of the photosensitive drum 21 is corrected.

<3-3. Third Modified Embodiment>

FIG. 12 is a flowchart depicting a flow of processing of a third modified embodiment. In the above exemplary embodiment, when the printing processing of step S22 is finished, the control unit 80 always returns to step S21 and is in the standby state in which it waits for an input of a printing request. In contrast, in the third modified embodiment, when the printing processing of step S22 is over, the control unit 80 first determines whether the worked time of the drum cartridge 20 (drum-worked time) stored in the drum memory 22 is longer than the drum-worked time threshold value stored in the main body memory 82 (step S24). When the control unit 80 determines that the drum-worked time is longer than the drum-worked time threshold value (step S24: yes), the control unit 80 sets the drum secular change flag stored in the main body memory 82 to ON (step S25). Then, the control unit 80 proceeds to processing of step S5 shown in FIG. 4.

On the other hand, when the control unit 80 determines that the drum-worked time is equal to or shorter than the drum-worked time threshold value (step S24: no), the control unit 80 determines whether the worked time of the developing cartridge 30 (toner-worked time) stored in the toner memory 32 is longer than the toner-worked time threshold value stored in the main body memory 82 (step S26). When the control unit 80 determines that the toner-worked time is longer than the toner-worked time threshold value (step S26: yes), the control unit 80 sets the toner secular change flag stored in the main body memory 82 to ON (step S27). Then, the control unit 80 proceeds to processing of step S5 shown in FIG. 4.

On the other hand, when the control unit 80 determines that the toner-worked time is equal to or shorter than the toner-worked time threshold value, the control unit 80 returns to step S21 and is in the standby state in which it waits for an input of a printing request.

That is, in the third modified embodiment, even in the case that the power supply of the image forming apparatus 1 is not switched from the off state to the on state or the opening 130 is not switched from the opened state to the closed state by the cover 12 in the state in which the power supply of the image forming apparatus 1 is in the on state, the control unit 80 executes the resister pitch measuring processing when predetermined time elapses. In this way, even when the variations in printing pitch changes over time, the control unit 80 can calculate an appropriate correction value, in correspondence to the change. Therefore, when executing the printing processing, it is possible to correct the variations in printing pitch, based on the appropriate correction value.

In the meantime, the sequence of the determination processing of step S24 and step S26 may be reversed.

<3-4. Other Modified Embodiments>

In the above exemplary embodiment, the number of the drum cartridges 20 to be mounted to the frame 11 of the image forming apparatus 1 is four. However, the number of the drum cartridges to be mounted to the frame of the image forming apparatus may be 1 to 3 or 5 or more.

Also, in the above exemplary embodiment, one developing cartridge 30 is mounted to one drum cartridge 20. However, the plurality of developing cartridges 30 may be mounted to one drum cartridge. For example, the four developing cartridges may be mounted to one drum cartridge. Also, the drum cartridge may include a plurality of photosensitive drums, in correspondence to the number of the developing cartridges to be mounted thereto.

Also, in the above exemplary embodiment, the control unit 80 determines in step S402 whether the developing cartridge 30 is exchanged, based on the toner identification information read out from the toner memory 32. However, the developing cartridge 30 may include a detection gear for determining whether the developing cartridge is exchanged. The control unit 80 may determine whether the developing cartridge 30 is exchanged, based on rotation of the detection gear.

Also, the configuration of the image forming apparatus and the details of the processing may be appropriately changed without departing from the gist of the present disclosure. Also, the respective elements disclosed in the exemplary embodiment and the modified embodiments may be appropriately combined without causing any contradiction.

What is claimed is:

1. An image forming apparatus comprising:

a frame;

a drum cartridge mountable to the frame, and including a photosensitive drum and a drum memory in which drum identification information is stored;

a control unit including a main body memory in which the drum identification information is to be stored; and a developing cartridge mountable to the drum cartridge, and including:

a developing roller being in contact with the photosensitive drum; and a toner memory in which toner identification information identifying the developing cartridge is stored, wherein the drum identification information capable of identifying each drum cartridge, the control unit is configured to execute:

first readout processing of reading out the drum identification information from the drum memory of the drum cartridge mounted to the frame;

drum determination processing of determining whether the drum identification information read out in the first readout processing coincides with the drum identification information stored in the main body memory; and resister pitch measuring processing of measuring variations in printing pitch due to the photosensitive drum, wherein in a case where it is determined in the drum determination processing that the drum identification information read out in the first readout processing coincides with the drum identification information stored in the main body memory, the control unit does not execute the resister pitch measuring processing, wherein the toner identification information is stored in the main body memory, wherein the control unit is further configured to execute:

second readout processing of reading out the toner identification information from the toner memory of the developing cartridge mounted to the frame in a state where the developing cartridge is mounted to the drum cartridge, and toner determination processing of determining whether the toner identification information read out in the second readout processing coincides with the toner identification information stored in the main body memory, and wherein in a case where it is determined in the toner determination processing that the toner identification information read out in the second readout processing coincides with the toner identification information stored in the main body memory, the control unit does not execute the resister pitch measuring processing.

2. The image forming apparatus according to claim 1, wherein in a case where it is determined in the drum determination processing that the drum identification information read out in the first readout processing does not coincide with the drum identification information stored in the main body memory, the control unit stores, in the main body memory, the drum identification information read out in the first readout processing.

3. The image forming apparatus according to claim 1, wherein in a case where it is determined in the toner determination processing that the toner identification information read out in the second readout processing does not coincide with the toner identification information stored in the main body memory, the control unit stores, in the main body memory, the toner identification information read out in the second readout processing.

4. The image forming apparatus according to claim 1, wherein worked time of the developing cartridge is stored in the toner memory, wherein the control unit is configured to execute:

fourth readout processing of reading out the worked time of the developing cartridge from the toner memory; and toner-worked time determination processing of determining whether the worked time read out in the fourth readout processing is longer than a threshold value, and wherein in a case where it is determined in the toner-worked time determination processing that the worked time is equal to or shorter than the threshold value, the control unit does not execute the resister pitch measuring processing.

5. The image forming apparatus according to claim 4, wherein a condition meeting specific toner identification information is stored in the main body memory, wherein in a case where it is determined that the toner identification information read out in the second readout processing meets the condition stored in the main body memory, the control unit sets the threshold value to a third threshold value, and wherein in a case where it is determined that the toner identification information read out in the second readout processing does not meet the condition stored in the main body memory, the control unit sets the threshold value to a fourth threshold value smaller than the third threshold value.

6. The image forming apparatus according to claim 1, wherein in a case where a correction value corresponding to the variations in printing pitch is stored in the drum memory, the control unit reads out the correction value from the drum memory without executing the resister pitch measuring processing.

7. The image forming apparatus according to claim 6, further comprising:

a light source configured to irradiate light toward an outer peripheral surface of the photosensitive drum, wherein the control unit is configured to correct an irradiation timing of light from the light source based on the correction value, during printing processing.

8. The image forming apparatus according to claim 7, wherein the light source is an LED.

9. The image forming apparatus according to claim 1, wherein the frame has an opening through which the drum cartridge passes when the drum cartridge is inserted into the frame, wherein the image forming apparatus further comprises a cover configured to cover the opening of the frame, and wherein when a power supply of the image forming apparatus is switched from an off state to an on state or when the opening is switched from an opened state to a closed state by the cover, the control unit executes the first readout processing and the drum determination processing.

10. An image forming apparatus comprising:

a frame;

a drum cartridge mountable to the frame, and including a photosensitive drum and a drum memory in which drum identification information identifying the drum cartridge is stored; and a control unit including a main body memory in which the drum identification information is to be stored, wherein the drum identification information capable of identifying each drum cartridge, the control unit is configured to execute:

first readout processing of reading out the drum identification information from the drum memory of the drum cartridge mounted to the frame;

drum determination processing of determining whether the drum identification information read out in the first readout processing coincides with the drum identification information stored in the main body memory; and resister pitch measuring processing of measuring variations in printing pitch due to the photosensitive drum, wherein in a case where it is determined in the drum determination processing that the drum identification information read out in the first readout processing coincides with the drum identification information stored in the main body memory, the control unit does not execute the resister pitch measuring processing, wherein the control unit is configured to execute:

third readout processing of reading out worked time of the drum cartridge, which is stored in the drum memory, from the drum memory; and drum-worked time determination processing of determining whether the worked time read out in the third readout processing is longer than a threshold value, and wherein in a case where it is determined in the drum-worked time determination processing that the worked time is equal to or shorter than the threshold value, the control unit does not execute the resister pitch measuring processing.

11. The image forming apparatus according to claim 10, wherein in a case where it is determined that the drum identification information read out in the first readout processing meets a condition meeting specific drum identification information, which is stored in the main body memory, the control unit sets the threshold value to a first threshold value, and wherein in a case where it is determined that the drum identification information read out in the first readout processing does not meet the condition stored in the main body memory, the control unit sets the threshold value to a second threshold value smaller than the first threshold value.

12. An image forming apparatus comprising:

a frame;

a drum cartridge mountable to the frame, and including a photosensitive drum and a drum memory in which drum identification information identifying the drum cartridge is stored;

a control unit including a main body memory in which the drum identification information is to be stored, an original point sensor measuring a rotation period of the photosensitive drum;

a belt movable with being in contact with the photosensitive drum; and an image sensor configured to read a toner image transferred from the photosensitive drum to the belt, wherein the drum identification information capable of identifying each drum cartridge, the control unit is configured to execute:

first readout processing of reading out the drum identification information from the drum memory of the drum cartridge mounted to the frame;

drum determination processing of determining whether the drum identification information read out in the first readout processing coincides with the drum identification information stored in the main body memory; and resister pitch measuring processing of measuring variations in printing pitch due to the photosensitive drum, wherein in a case where it is determined in the drum determination processing that the drum identification information read out in the first readout processing coincides with the drum identification information stored in the main body memory, the control unit does not execute the resister pitch measuring processing, and wherein the control unit is configured to calculate a correction value corresponding to the variations in printing pitch based on a measurement result of the original point sensor and a toner image acquired from the image sensor, in the resister pitch measuring processing.

13. The image forming apparatus according to claim 12, wherein a rotating speed of the photosensitive drum during the resister pitch measuring processing is faster than a rotating speed of the photosensitive drum during printing processing.

* * * * *